US008257115B2

(12) United States Patent
Herring

(10) Patent No.: US 8,257,115 B2
(45) Date of Patent: Sep. 4, 2012

(54) SENSOR ASSEMBLY FOR AN ELECTRICAL DEVICE

(75) Inventor: Michael David Herring, Apex, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 35 days.

(21) Appl. No.: 12/862,237

(22) Filed: Aug. 24, 2010

(65) Prior Publication Data

US 2012/0052708 A1 Mar. 1, 2012

(51) Int. Cl.
*H01R 13/66* (2006.01)

(52) U.S. Cl. ..... 439/620.21; 439/913

(58) Field of Classification Search ..... 439/620.21, 439/620.22, 913, 79, 660
See application file for complete search history.

(56) References Cited

U.S. PATENT DOCUMENTS

| | | | | |
|---|---|---|---|---|
| 6,506,069 | B2 * | 1/2003 | Babala et al. | 439/248 |
| 6,717,809 | B2 | 4/2004 | Chen et al. | |
| 6,883,364 | B2 * | 4/2005 | Sunshine et al. | 73/23.34 |
| 7,044,751 | B2 * | 5/2006 | Takanashi et al. | 439/76.2 |
| 7,568,940 | B2 | 8/2009 | Cheng et al. | |
| 7,591,681 | B1 | 9/2009 | Zhang et al. | |

* cited by examiner

*Primary Examiner* — Khiem Nguyen

(57) ABSTRACT

A sensor assembly includes a jack having a mounting end and a mating. The mounting end is configured to be mounted to a card assembly. The mating end has jack contacts. A plug is provided having a mating end and a sensor end. The mating end has plug contacts. The mating end of the plug is configured to be inserted into the mating end of the jack such that the plug contacts engage the jack contacts. A sensor is provided having a lead. The lead is configured to be inserted into the sensor end of the plug to electrically couple the sensor to the card assembly.

20 Claims, 9 Drawing Sheets

SENSOR ASSEMBLY FOR AN ELECTRICAL DEVICE

BACKGROUND OF THE INVENTION

The subject matter described herein relates to electrical devices and, more particularly, to a sensor assembly for an electrical device.

Electrical devices generally include card assemblies utilized to operate the device. The card assembly may include multiple components such as electrical modules. The modules convey electrical currents and data signals to power and/or operate the device. Often, the currents and signals conveyed by the modules produce a substantial amount of heat. The heat May cause damage to the card assembly. For example, excessive heat may melt portions of the card assembly and/or cause electrical shorts that may permanently damage the device. Some conventional devices include temperature sensors that are configured to monitor heat produced by the modules. The operation of the device may then be controlled to limit the amount of heat produced.

However, conventional temperature sensors are not without their disadvantages. Conventional temperature sensors include leads that are coupled to the card assembly. The leads may be through-hole mounted to the card assembly. The leads may also be soldered and/or welded to the card assembly. Typically, the connection between the leads and the card assembly is permanent. Accordingly, the temperature sensor cannot be replaced without reworking the entire card assembly. In some cases, the card assembly ma have to be replaced due to a damaged temperature sensor.

A need remains for a temperature sensor capable of being removably coupled to a card assembly without reworking the card assembly.

SUMMARY OF THE INVENTION

In one embodiment, a sensor assembly is provided. The assembly includes a jack having a mounting surface and a mating end. The mounting surface is configured to be mounted to a card assembly. The mating end has jack contacts. A plug is provided having a mating end and a sensor end. The mating end has plug contacts. The mating end of the plug is configured to be inserted into the mating end of the jack such that the plug contacts engage the jack contacts. A sensor is provided having a lead. The lead is configured to be inserted into the sensor end of the plug to electrically couple the sensor to the card assembly.

In another embodiment, an electrical assembly is provided. The assembly includes a card assembly and a jack having a mounting surface and a mating end. The mounting surface is mounted to the card assembly such that the jack is positioned at least one of substantially parallel to or substantially perpendicular to a surface of the card assembly. The mating end has jack contacts. A plug is provided having a mating end and a sensor end. The mating end has plug contacts. The mating end of the plug is configured to be inserted into the mating end of the jack such that the plug contacts engage the jack contacts. A sensor is provided, having a lead. The lead is configured to be inserted into the sensor end of the plug to electrically couple the sensor to the card assembly.

In another embodiment, a sensor assembly is provided. The assembly includes a jack having a mounting surface and a mating end. The mounting surface is configured to be mounted to a card assembly. The mating end has jack contacts. A plug is provided having, a mating end and a sensor end. The mating end has plug contacts. The mating end of the plug is configured to be inserted into the mating end of the jack such that the plug contacts engage the jack contacts. A contact assembly is provided and configured to be inserted into the sensor end of the plug. A sensor is provided having a lead. The lead is configured to couple to the contact assembly to electrically couple the sensor to the card assembly.

DETAILED DESCRIPTION OF THE DRAWINGS

The foregoing summary, as well as the flowing detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
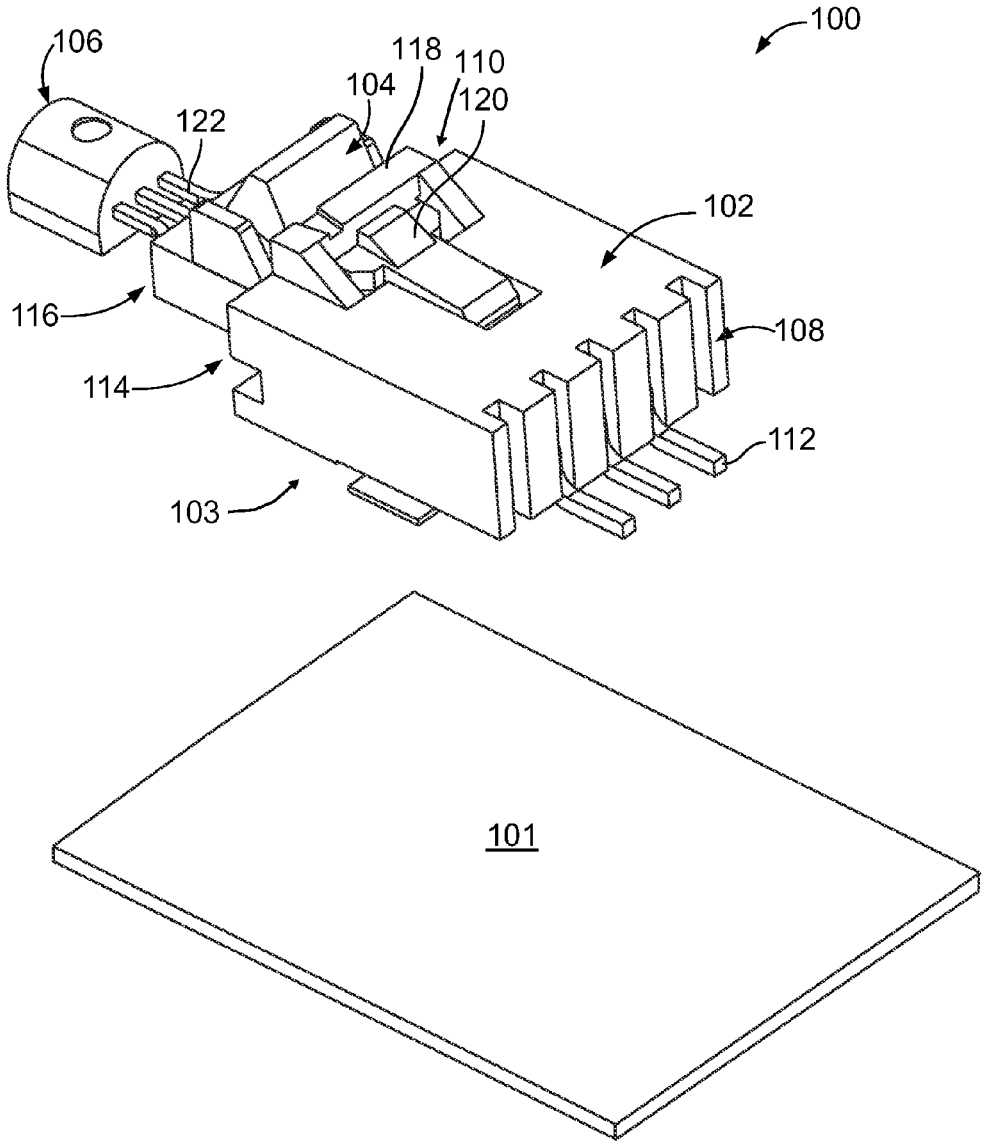
FIG. 1 is to top perspective view of a sensor assembly formed in accordance with an embodiment.

FIG. 1 illustrates a sensor assembly 100 formed in accordance with an embodiment. The sensor assembly 100 includes a jack 102 and a plug 104 removably inserted into the jack 102. A sensor 106 is joined to the plug 104. The jack 102 is configured to mount to a card assembly 101 so that the sensor 106 is electrically coupled to the card assembly 101. The sensor 106 is configured to monitor properties of the card assembly 101. For example, the sensor 106 may be a temperature sensor configured to monitor a temperature of the card assembly 101. In another embodiment, the sensor 106 may monitor a voltage and/or amperage of the card assembly 101 or the like. In one embodiment, the sensor 106 may monitor a current through the card assembly 101 and/or a speed of signals through the card assembly 101. The plug 104 is removable from the jack 102 so that the sensor 106 may be removed from the card assembly 101 and replaced without re-working the card assembly 101.

The jack 102 includes a contact end 108 and an opposite mating end 110. The contact end 108 includes card contacts 112 extending therefrom. The card contacts are configured to be joined to the card assembly 101. The card contacts 112 may be soldered and/or welded to the card assembly 101. Alternatively, the card contacts 112 may be connected to the card assembly 101 with conductive adhesive. In another embodiment, the card contacts 112 may be through-hole mounted to the card assembly 101. The jack 102 includes a mounting surface 103 extending between the contact end 108 and the mating end 110. The mounting surface 103 of the jack 102 is configured to be mounted to the card assembly 101 so that the jack 102 extends from the contact end 108 to the mating end 110 substantially parallel to a surface of the card assembly 101.

The plug 104 is joined to the mating, end 110 of the jack 102. The plug 104 includes a mating end 114 and a sensor end 116. The mating end 114 of the plug 104 is inserted into the mating end 110 of the jack 102. The jack 102 includes a latch 118. The plug 104 includes a tab 120. The tab 120 cooperates with the latch 118 to secure the plug 104 to the jack 102. The sensor end 116 of the plug 104 is joined to the sensor 106. The sensor 106 includes leads 122. The leads 122 are inserted into the sensor end 116 of the plug 104.

Figure 2:
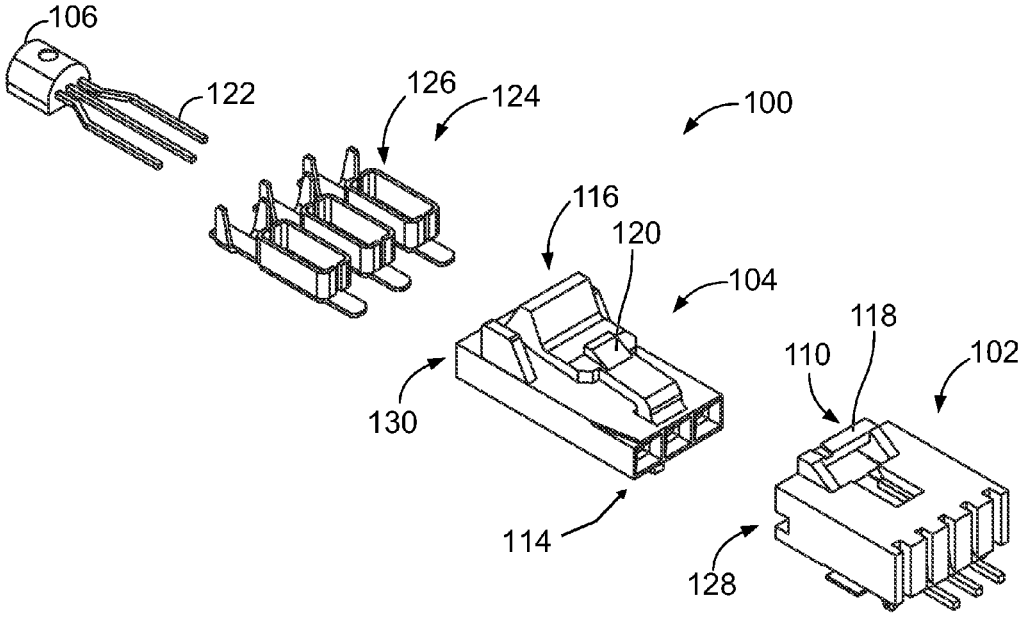
FIG. 2 is an exploded view of the sensor assembly shown in FIG. 1.

FIG. 2 is an exploded view of the sensor assembly shown 100. The plug 104 has an opening 130 formed in the sensor end 116 of the plug 104. A contact assembly 124 is configured to be inserted into the opening 130 of the plug 104. The contact assembly 124 includes a plurality of contacts 126. Each of the contacts 126 is configured to receive a lead 122 of the sensor 106. The contact assembly 124 may include one contact 126 per lead 122 of the sensor 106. Optionally, the contact assembly 124 may include more contacts 126 than leads 122. The additional contacts 126 may be joined to leads from another sensor or the like. The contact assembly 124 is configured to be inserted into the sensor end 116 of the plug 104 after the leads 122 are coupled thereto. Optionally, the leads 122 may be inserted into the contact assembly 124 after the contact assembly 124 is inserted into the plug 104.

The jack 102 includes an opening 128. The opening 128 is located at the mating end 110 of the jack 102. The opening 128 is sized to receive the mating end 114 of the plug 104. The jack 102 receives the plug 104 to create an electrical connection between the plug 104 and the jack 102. The jack 102 receives the plug to create an electrical connection with the contact assembly 124 and the sensor 106. The plug 104 is retained within the jack 102 by the latch 118 and the tab 120. Alternatively, the plug 104 may be retained within the jack 102 through an interference fit. In another embodiment, the plug 104 is retained within the jack 102 with other suitable coupling mechanisms, for example, a tongue and groove or the like.

Figure 3:
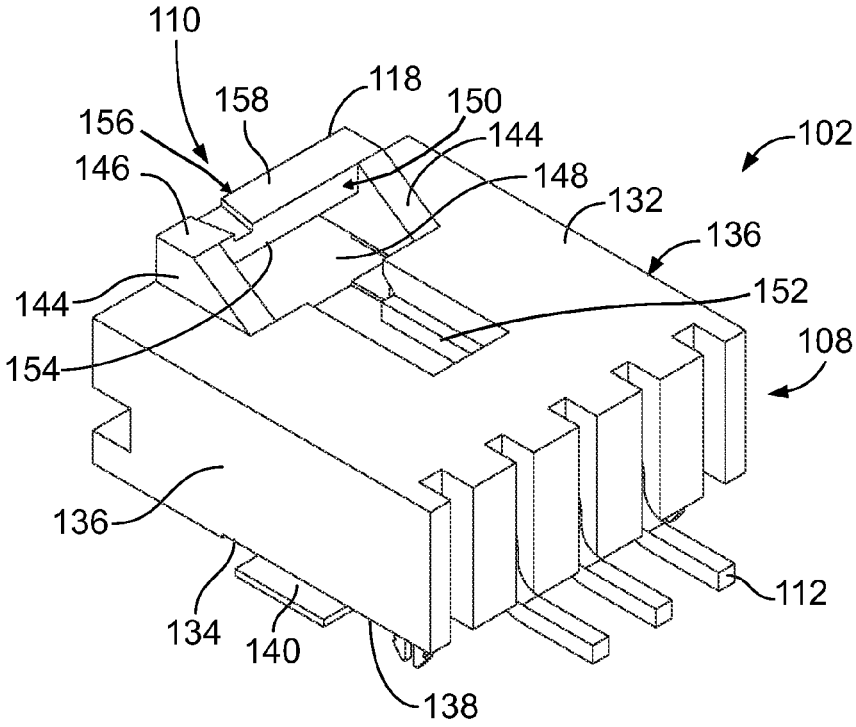
FIG. 3 is a top perspective view of the jack shown in FIG. 2.

FIG. 3 illustrates the jack 102. The jack 102 includes a top 132 and an opposite bottom 134. The top 132 and the bottom 134 extend between the contact end 108 and the mating end 110. Sides 136 extend between the top 132 and the bottom 134. The bottom 134 has a mounting surface 138. The mounting surface 138 is configured to position flat on a surface of a card assembly 101 (shown in FIG. 1). The jack 102 is positioned on the card assembly 101 so that the mounting, surface 138 extends parallel to the surface of the card assembly 101. The mounting surface 138 of the jack 102 may be fixed to the card assembly 101. For example, the mounting surface 138 may be soldered or welded to the card assembly 101. Optionally, the mounting surface 138 may include tabs and/or posts configured to be received in apertures formed in the card assembly 101.

The card contacts 112 of the jack 102 extend from the contact end 108 of the jack 102. The card contacts 112 extend proximate to the bottom 134 of the jack 102. The card contacts 112 may extend in the same plane as the mounting surface 138 of the jack 102. In one embodiment, the card contacts 112 may extend from any location of the contact end 108 and bend toward a plane farmed by the mounting surface 138. The card contacts 112 are configured to electrically connect to the card assembly 101. The card contacts 112 are configured to convey power and/or data signals between the card assembly 101 and the jack 102. The card contacts 112 may also provide structural support far the sensor assembly 100 by retaining the jack 102 on the card assembly 101.

The jack 102 includes mounting tabs 140. The mounting tabs 140 extend from the sides 136 of the jack 102. The mounting tabs 140 are located, at an intermediate position between the contact end 108 and the mating end 110 of the jack 102. Optionally, the mounting tabs 140 may be positioned proximate to the contact end 108 and/or the mating end 110 of the jack 102. In another embodiment, mounting tabs 140 may extend from the contact end 108 and/or the mating end 110. The mounting tabs 140 are positioned proximate to the bottom 134 of the jack 102. The mounting tabs 140 may extend in the same plane as the mounting surface 138 of the jack 102. In another embodiment, the mounting tabs 140 may extend from any intermediate location of the sides 136 and bend toward a plane formed by the mounting surface 138 of the jack 102.

The mounting tabs 140 are configured to retain the jack 102 on the card assembly 101. The mounting tabs 140 may be soldered and/or welded to the card assembly 101. Optionally, the mounting tabs 140 may be held to the card assembly 101 with adhesive. In another embodiment, the mounting tabs 140 may be through-hole mounted into the card assembly 101. In one embodiment, the mourning tabs 140 may be electrically conductive. In such an embodiment, the mounting tabs 140 may convey power and/or data signals between the jack 102 and the card assembly 101.

The latch 118 is positioned on the mating end 110 of the jack 102. The latch 118 extends from the top 132 of the jack and is centered with respect to the sides 136 of the jack 102. In another embodiment, the latch 118 may be positioned at any intermediate location between the sides 136. Alternatively, the jack 102 may include multiple latches located at various positions between the sides 136. In one embodiment, at least one of the sides 136 includes a latch 118.

The latch 118 includes arms 144 and a crossbar 146. The arms 144 extend from the top 132 of the jack 102. The crossbar 146 extends between the arms 144. The crossbar 146 includes an engagement end 150 and a connection end 156. A bottom surface 154 and a top surface 158 extend between the engagement end 150 and the connection end 156. The arms 144 and the crossbar 146 form an opening 148. The opening 148 is configured to receive the tab 120 (shown in FIG. 1) of the plug 104. When the plug 104 in fully inserted into the jack 102, the tab 120 is configured to engage the engagement end 150 of the crossbar 146 to retain the plug 104 within the jack 102.

An alignment notch 152 is formed in the top 132 of the jack 102. The alignment notch 152 is centered in the top 132 of the jack 102. Alternatively, the alignment notch 152 may be positioned at any intermediate location of the top 132 of the jack 102. In one embodiment, the jack 102 includes multiple alignment notches 152 positioned at any intermediate location within the top 132 of the jack 102. The alignment notch 152 is configured to align the plug 104 within the opening 128 (shown in FIG. 2) of the jack 102.

Figure 4:
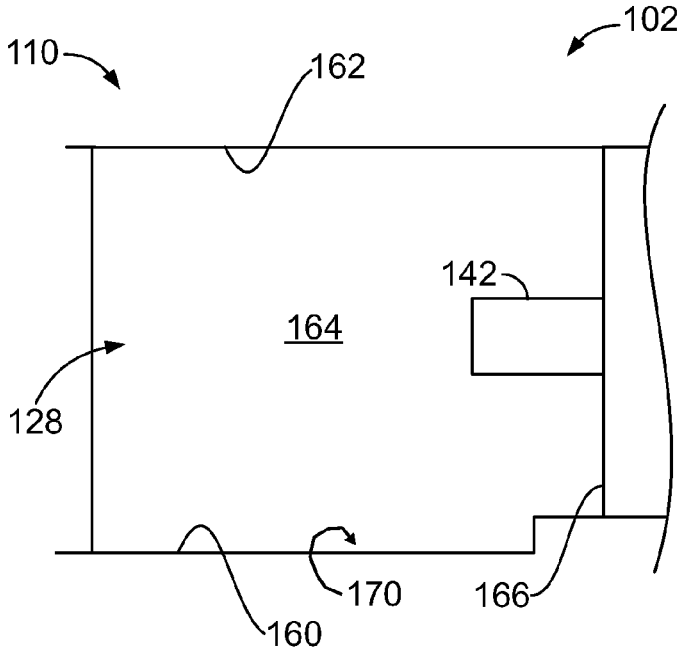
FIG. 4 is a cut-away view of a mating end of the jack shown in FIG. 3.

FIG. 4 illustrates a cut-away view of the mating end 110 of the jack 102. The opening 128 of the jack 102 is formed in the mating end 110 of the jack 102. The opening 128 is sized to receive the plug 104 (shown in FIG. 2). The opening 128 includes a bottom surface 160 and a top surface 162. Side surfaces 164 extend between the bottom surface 160 and the top surface 162. A connection surface 166 extends between the bottom surface 160 and the top surface 162. The connection surface 166 is formed between the side surfaces 164.

The opening 128 includes jack contacts 142 positioned therein. The jack contacts 142 are positioned along the connection surface 166 of the opening 128. Optionally, the jack contacts 142 may be positioned along the bottom surface 160, the top surface 162, and or the side surfaces 164. The jack contacts 142 are configured as posts. Optionally, the jack contacts 142 may be configured as outlets, spring contacts and/or the like. The jack contacts 142 may be formed from copper and/or any other suitable conductive material. The jack contacts 142 are joined, to and in electrical communication with the card contacts 112. Data and/or power signals are configured to be conveyed between the jack contacts 142 and the card contacts 112. The jack contacts 142 are configured to engage the plug 104 when the plug 104 is inserted into the jack 102.

An alignment groove 170 is formed in the bottom surface 160 of the opening 128. The alignment groove 170 extends toward the connection surface 166. Optionally, the alignment groove 170 may extend partially to the connection surface 166. In one embodiment, the jack 102 may include multiple alignment grooves 170. In another embodiment, alignment grooves 170 may be formed on the top surface 162, and or the side surfaces 164 of the opening 128. The alignment groove 170 is configured to align the plug 104 within the jack 102.

Figure 5:
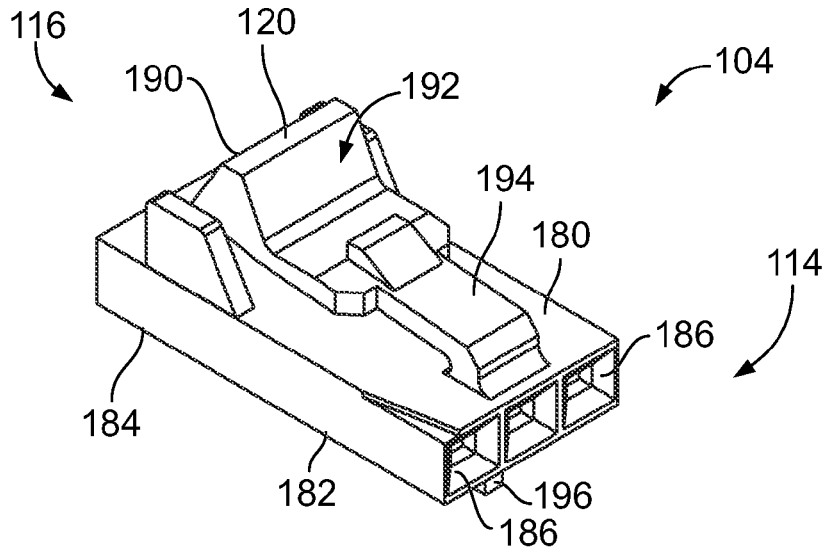
FIG. 5 is a top perspective view of the plug shown in FIG. 2.

FIG. 5 illustrates the plug 104. The plug 104 includes a top 180 and a bottom 182 extending; between the sensor end 116 and the mating end 114 of the plug 104. Sides 184 are formed between the top 180 and the bottom 182. The mating end 114 of the plug 104 includes plug contacts 186. The plug contacts 186 may be formed from conductive cooper and/or any other suitable conductive material. The plug contacts 186 are formed as outlets that are configured to receive the jack contacts 142 (shown in FIG. 4) of the jack 102 (shown in FIGS. 3 and 4). Optionally, the plug contacts 186 and the jack contacts 142 may be thrilled as any corresponding electrical contacts. The number of plug contacts 186 corresponds to the number of jack contacts 142. The plug contacts 186 receive the jack contacts 142 to provide an electrical connection between the plug 104 and the jack 102. The plug contacts 186 and the jack contacts 142 are configured to convey data and/or power signals.

The tab 120 extends from the top 180 of the plug 104. The tab 120 is formed from a pliable material capable of being deflected. The tab 120 is sized to be received in the opening 148 (shown in FIG. 3) firmed by the crossbar 146 (shown in FIG. 3) of the jack 102. The tab 120 includes an inclined surface 192 and an engagement surface 190. The inclined surface 192 is configured slide along the connection end 156 (shown in FIG. 3) of the crossbar 146 as the plug 104 is inserted into the jack 102. The tab 120 is deflected and is inserted into the opening 148. When the tab 120 is fully positioned within the opening 148, the tab returns to its undeflected condition and the engagement surface 190 confronts the engagement end 150 (shown in FIG. 3) of the crossbar 146 to secure the plug 104 within the jack 102. Force may be applied to deflect the tab 120 to disengage the tab 120 from the crossbar 146 so that the plug 104 can be removed from the jack 102.

An alignment tab 194 extends along the top 180 of the plug 104. The alignment tab 194 extends between the mating end 114 of the plug 104 and the tab 120. The alignment tab 194 is centered between the sides 184 of the plug 104. In one embodiment, the plug 104 may include any number of alignment tabs 194 positioned at any intermediate locations between the sides 184 of the plug 104. The alignment tab 194 is configured to be received within the alignment notch 152 (shown in FIG. 3) of the jack 102. The alignment tab 194 positions the plug 104 with respect to the jack 102 so that the plug 104 can be received within the jack 102.

An alignment protrusion 196 extends along the bottom 182 of the plug 104. The alignment protrusion 196 extends from the mating end 114 of the plug 104 toward the sensor end 116 of the plug 104. The alignment protrusion 196 may extend the entire length of the bottom 182 of the plug 104 or may extend only a portion of the length of the bottom 182 of the plug 104. In one embodiment, the plug 104 may include multiple alignment protrusions 196. Optionally, alignment protrusions 196 may be formed on the top 180 and/or the sides 184 of the plug 104. The alignment protrusion 196 is configured to engage the alignment groove 170 (shown in FIG. 4) of the jack 102. The alignment protrusion aligns the plug 104 with respect to the jack 102 as the plug 104 is inserted into the jack 102.

Figure 6:
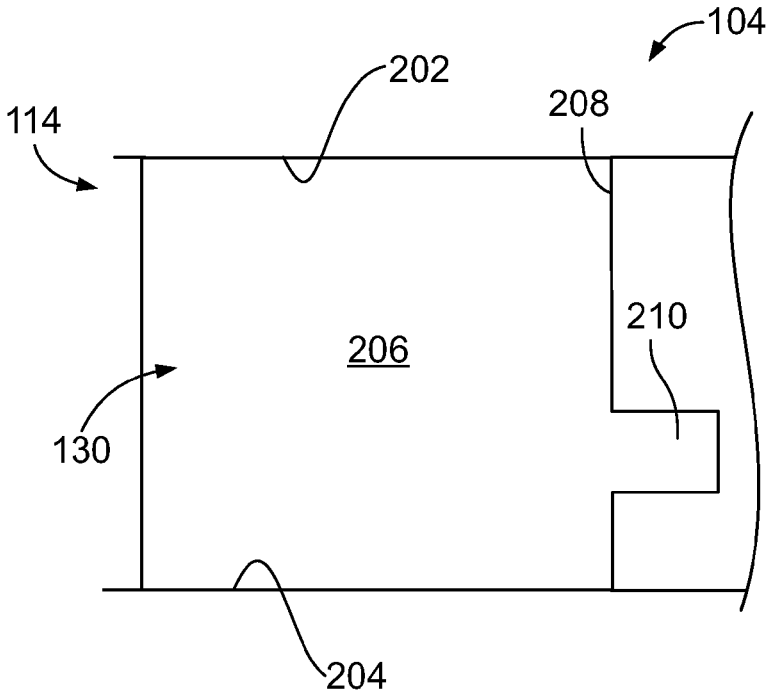
FIG. 6 is a cut-away view of a sensor end of the plug shown in FIG. 5.

FIG. 6 is a cut-away view of the sensor end 114 of the plug 104. The sensor end 114 of the plug 104 includes the opening 130 formed therein. The opening 130 is configured to receive the contact assembly 124 (shown in FIG. 2). The opening 130 includes a top surface 202 and a bottom surface 204. Side surfaces 206 extend between the top surface 202 and the bottom surface 204. A connection surface 208 extends between the top surface 202 and the bottom surface 204. The connection surface 208 is defined between the side surfaces 206. The connection surface 208 includes sensor contacts 210. Optionally, sensor contacts 210 may be positioned on the top surface 202, bottom surface 204, and/or the side surfaces 206. The sensor contacts 210 are electrically coupled to the plug contacts 186 (shown in FIG. 5). The sensor contacts 210 are formed as outlets. Optionally, the sensor contacts 210 may be farmed as posts, conductive springs, or the like. The sensor contacts 210 are configured to electrically couple to the contact assembly 124.

Figure 7:
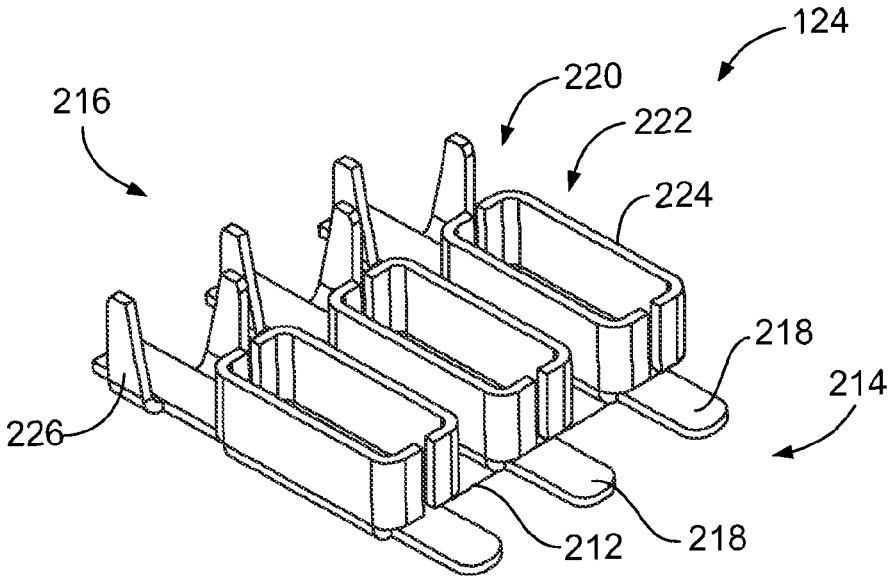
FIG. 7 is a top perspective view of the contact assembly shown in FIG. 2.

FIG. 7 illustrates the contact assembly 124. The contact assembly 124 includes a base 212. The base 212 has a plug end 214 and a sensor end 216. The plug end 214 includes prongs 218 configured to engage the sensor contacts 210 (shown in FIG. 6) of the plug (shown in FIGS. 5 and 6). The prongs 218 are configured to be inserted into the sensor contacts 210 to electrically couple the contact assembly 124 to the plug 104.

The sensor end 216 includes alignment flanges 220 that are configured to engage the leads 122 (shown in FIG. 1) of the sensor 106 (shown in FIG. 1). The alignment flanges 220 include a base 222 and sidewalk 224. The sidewalk 224 extend substantially perpendicular to the base 222. The leads 122 of the sensor 106 are configured to be positioned on the base 222 of the alignment flange 220 between the sidewalls 224. The alignment flanges 220 align the leads 122 with the prongs 218. Each lead 122 is then electrically coupled to a respective prong 218. The leads 122 may be coupled to the prongs 218 with a crimp. Alternatively, the leads 122 may be soldered and/or welded to the prongs 218. In another embodiment the leads 122 may be joined to the prongs 218 with a conductive adhesive.

Crimps 226 are positioned at the sensor end 216 of the contact assembly 124. The crimps 226 extend substantially perpendicular to the base 212 of the contact assembly 124. Each lead 122 of the sensor 106 is configured to be positioned between adjacent crimps 226. The crimps 226 are folded downward onto the lead 122 to secure the lead to the contact assembly 124.

Figure 8:
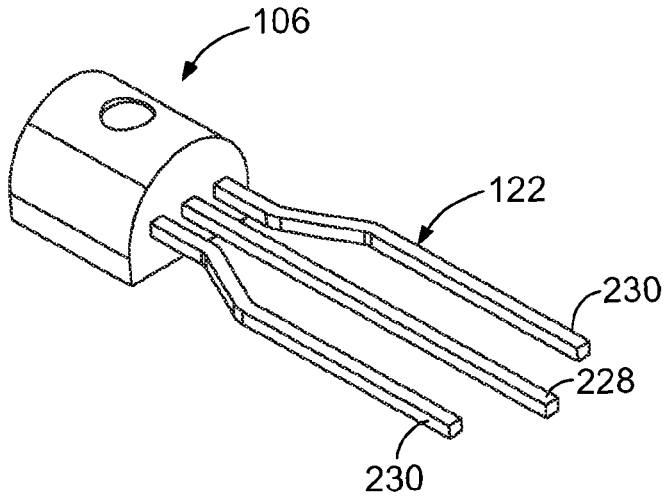
FIG. 8 is a top perspective view of the sensor shown in FIG. 2.

FIG. 8 illustrates the sensor 106. In an example embodiment, the sensor 106 is a temperature sensor. The sensor 106 includes three leads 122 extending therefrom. Optionally, the sensor 106 may include any suitable number of leads 122. The leads 122 include a ground lead 228 and sensing leads 230. Each sensing lead 230 is configured to sense a voltage of a card assembly. A temperature of the card assembly is determined based on a difference between the voltages sensed by the sensing leads 230.

Figure 9:
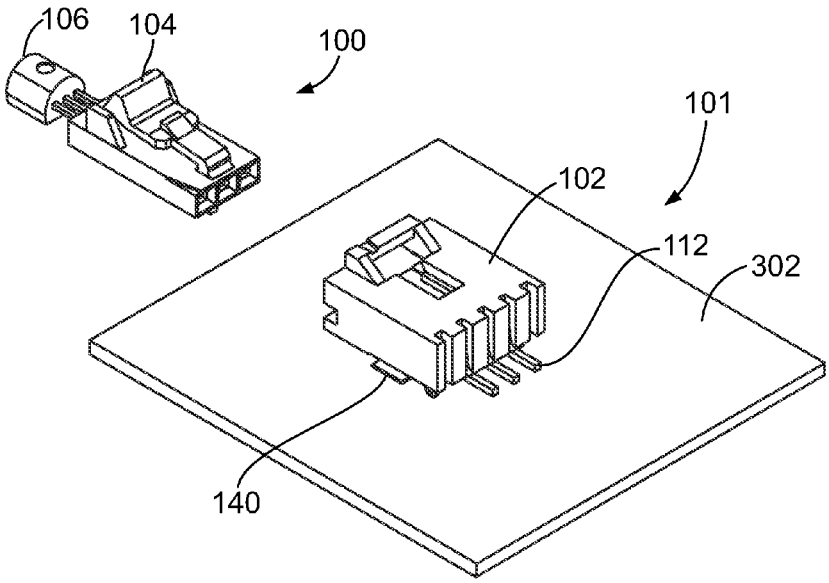
FIG. 9 is a top perspective view of a card assembly formed in accordance with an embodiment and having the sensor assembly shown in FIG. 2 mounted thereto in a pre-connected configuration.

FIG. 9 illustrates the card assembly 101 having the sensor assembly 100 mounted thereto in a pre-connected configuration. The card assembly 101 may be a circuit board, for example, a printed circuit board. The card assembly 101 may be a mother board, daughter board, midplane circuit hoard, or backplane circuit board. The card assembly 101 is configured to receive a plurality of electrical components (not shown) thereon. The electrical components may generate heat throughout the card assembly. The sensor assembly 100 is mounted to the card assembly 101 to monitor an amount of heat generated by the electrical components and/or the card assembly itself.

The card assembly 101 includes a surface 302. The mounting surface 103 of the jack 102 of the sensor assembly 100 is mounted to the surface 302 of the card assembly 101. The jack 102 is positioned so that the mounting surface 138 of the mounting surface 103 rests on the surface 302 of the card assembly 101. The jack 102 is oriented substantially parallel to the surface 302 of the card assembly 101. The mounting tabs 140 engage and are secured to the surface 302 of the card assembly 101. The mounting tabs 140 may be secured to pads provided on the surface 302 of the card assembly 101. The mounting tabs 140 secure the jack 102 to the card assembly 101.

The card contacts 112 of the jack 102 engage the surface 302 of the card assembly 101. The card contacts 112 are secured to the surface 302 of the card assembly 101. The surface 302 of the card assembly 101 may include pads to which the card contacts 112 are coupled. The card contacts 112 provide an electrical connection between the jack 102 and the card assembly 101.

The sensor 106 is coupled to the plug 104. An electrical connection is provided between the sensor 106 and the plug 104. The plug 104 is shown separated from the jack 102.

Figure 10:
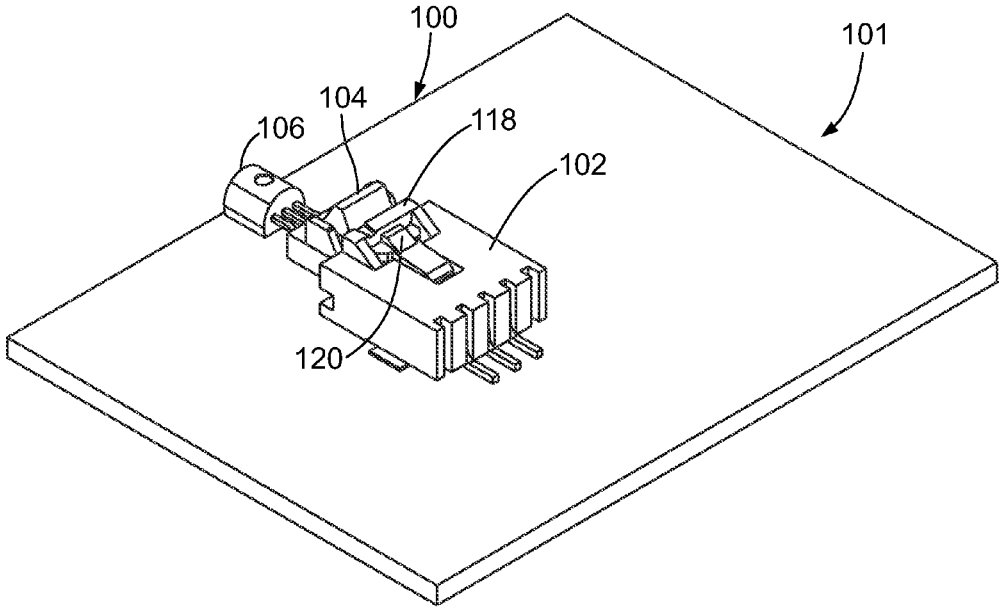
FIG. 10 is a top perspective view of the card assembly shown in FIG. 9 having the sensor assembly shown in FIG. 2 mounted thereto in a connected configuration.

FIG. 10 illustrates the card assembly 101 having the sensor assembly 100 mounted thereto in a connected configuration. The plug 104 is inserted into the jack 102. The tab 120 is engaged with the latch 118 to secure the plug 104 to the jack 102. An electrical connection is created between the plug 104 and the jack 102. The electrical connection electrically engages the sensor 106 and the card assembly 101. The sensor 106 detects properties of the card assembly 101 to monitor the health of the card assembly 101. For example, the sensor 106 may be a temperature sensor configured to monitor a temperature of the card assembly 101.

If the sensor 106 becomes damaged and/or malfunctions, the sensor 106 may be replaced without damaging and/or reworking the card assembly 101. The sensor 106 is replaceable by removing the plug 104 from the jack 102. A new sensor 106 may then be joined to the plug 104 and/or a new plug 104 having a working sensor 106 may replace the original plug 104.

Figure 11:
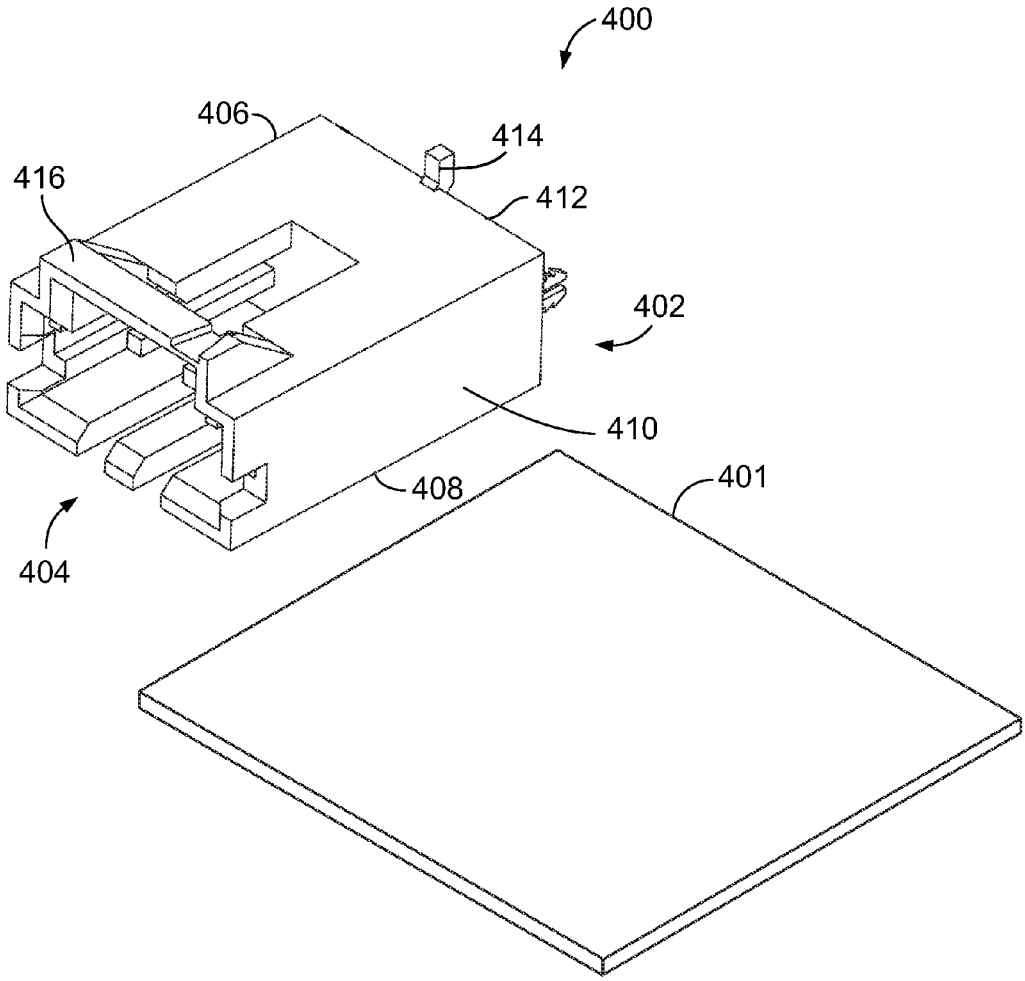
FIG. 11 is a top perspective view of a jack formed in accordance with an alternative embodiment.

FIG. 11 illustrates a jack 400 formed in accordance with an alternative embodiment. The jack 400 is configured to receive the plug 104 (shown in FIG. 5). The jack 400 includes a contact end 402 and a mating end 404. A top 406 and an opposite bottom 408 extend between the contact end 402 and the mating end 404. Sides 410 extend between the top 406 and the bottom 408. The contact end 402 includes a mounting surface 412. The mounting surface 412 is configured to position flat on a surface of a card assembly 401. The mounting surface 412 is positioned on the card assembly 401 so that the jack 400 extends perpendicular to the surface of the card assembly 401 from the contact end 402 to the mating end 404. The mourning surface 412 of the jack 400 may be fixed to the card assembly 401. For example, the mounting surface 412 may be soldered or welded to the card assembly 401. Optionally, the mounting surface 412 may include tabs and/or posts configured to be received in apertures formed in the card assembly 401.

Card contacts 414 extend from the contact end 402 of the jack 400. The card contacts 414 extend proximate to the top 406 of the jack 400. The card contacts 414 may extend in the same plane as the mounting surface 412 of the jack 400. In one embodiment, the card contacts 414 may extend proximate to the bottom 408 of the jack 400. The card contacts 414 are configured to electrically connect to the card assembly 401. The card contacts 414 are configured to convey power and/or data signals between the card assembly 401 and the jack 400. The card contacts 414 may also provide structural support by retaining the jack 400 on the card assembly 401.

A latch 416 is positioned on the mating end 404 of the jack 400. The latch 416 extends from the top 406 of the jack 400 and is centered with respect to the sides 410 of the jack 400. In another embodiment, the latch 416 may be positioned at any intermediate location between the sides 410. Alternatively, the jack 400 may include multiple latches located at various positions between the sides 410. In one embodiment, at least one of the sides 410 includes a latch 416. The latch 416 is configured to receive the tab 120 (shown in FIG. 5) of the plug 104.

The jack 400 includes jack contacts (not shown) positioned within an opening (not shown) in the mating end 404 of the jack 400. The jack contacts are configured to engage the plug contacts 186 (shown in FIG. 5) of the plug 104 to electrically couple the plug 104 and the jack 400. The jack 400 is configured to electrically engage the sensor 106 through the plug 104.

Figure 12:
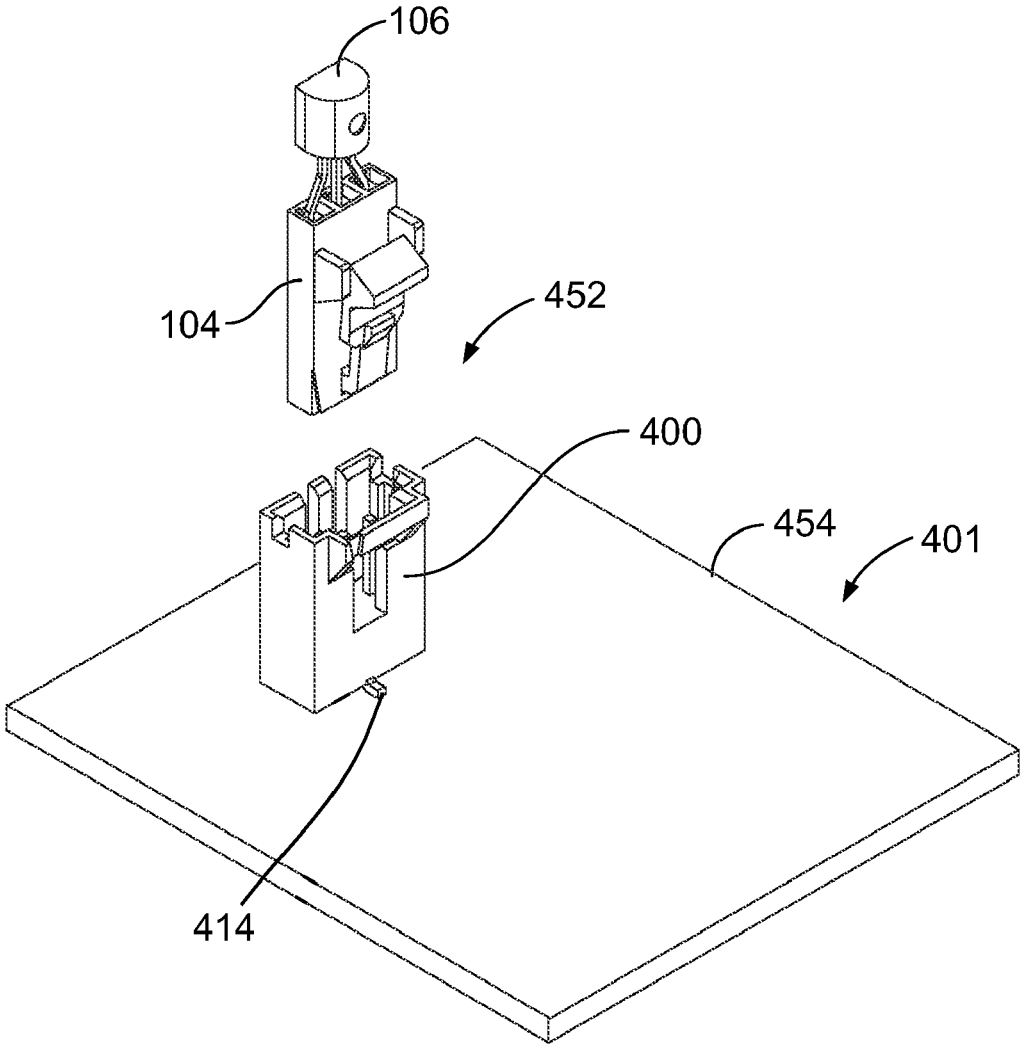
FIG. 12 top perspective view of a card assembly formed in accordance with an embodiment and having a sensor assembly mounted thereto in a pre-connected configuration.

FIG. 12 illustrates the card assembly 401 having a sensor assembly 452 mounted thereto in a pre-connected configuration. The sensor assembly 452 includes the jack 400, the plug 104, and the temperature sensor 106. The card assembly 401 may be a circuit board, for example, a printed circuit board. The card assembly 401 may be a mother board, daughter board, midplane circuit board, or backplane circuit board. The card assembly 401 is configured to receive a plurality of electrical components (not shown) thereon. The electrical components may generate heat throughout the card assembly. The sensor assembly 452 is mounted to the card assembly 401 to monitor an amount of heat generated by the electrical components and/or the card assembly itself.

The card assembly 401 includes a surface 454. The jack 400 is mounted to the surface 454 of the card assembly 401. The jack 400 is positioned so that the mounting surface 412 of the jack 400 rests on the surface 454 of the card assembly 401.

The jack 400 is oriented, substantially perpendicular to the surface 454 of the card assembly 401. The card contacts 414 of the jack 400 engage the surface 454 of the card assembly 401. The card contacts 414 are secured to the surface 454 of the card assembly 401. The surface 454 of the card assembly 401 may include pads to which the card contacts 414 are coupled. The card contacts 414 provide an electrical connection between the jack 400 and the card assembly 401.

The sensor 106 is coupled to the plug 104. An electrical connection is provided between the sensor 106 and the plug 104. The plug 104 is shown separated from the jack 102.

Figure 13:
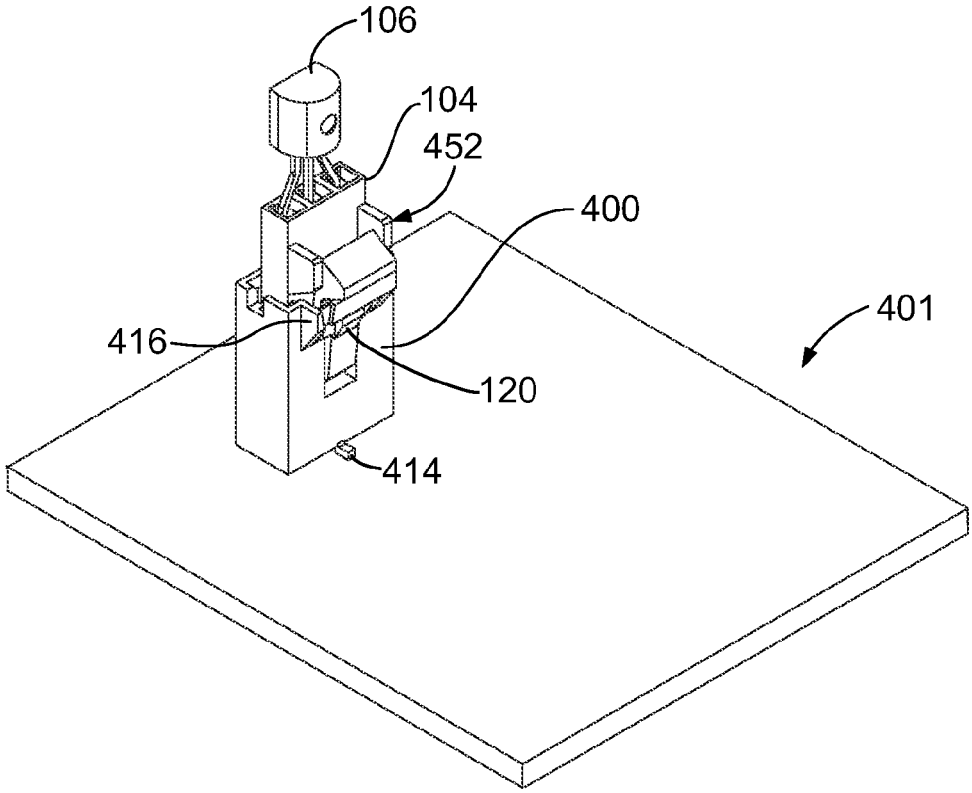
FIG. 13 top perspective view of the card assembly shown in FIG. 12 and having a sensor assembly mounted thereto in a connected configuration.

FIG. 13 illustrates the card assembly 401 having the sensor assembly 452 mounted thereto in a connected configuration. The plug 104 is inserted into the jack 400. The tab 120 is engaged with the latch 416 to secure the plug 104 to the jack 400. An electrical connection is created between the plug 104 and the jack 400. The electrical connection electrically engages the sensor 106 and the card assembly 401. The sensor 106 detects properties of the card assembly 401 to monitor the health of the card assembly 401. For example, the sensor 106 may be a temperature sensor configured to monitor a temperature of the card assembly 401.

If the sensor 106 becomes damaged and/or malfunctions, the sensor 106 may be replaced without damaging and/or reworking the card assembly 401. The sensor 106 is replaceable by removing the plug 104 from the jack 400. A new sensor 106 may then be joined to the plug 104 and/or a new plug 104 having a working sensor 106 may replace the original plug 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described, herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first" "second." and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice various embodiments of the invention including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A sensor assembly comprising:

a jack having a mounting surface and a mating end, the mounting surface configured to be mounted to a card assembly, the mating end having jack contacts;

a plug having a mating end and a sensor end, the mating end having plug contacts, the mating end of the plug configured to be inserted into the mating end of the jack such that the plug contacts engage the jack contacts; and a sensor having a lead, the sensor configured to monitor the card assembly, the lead configured to be inserted into the sensor end of the plug to electrically couple the sensor to the card assembly wherein the sensor senses a property of the card assembly.

2. The sensor assembly of claim 1, wherein the jack includes a latch and the plug includes a tab, the tab configured to engage the latch to secure the plug to the jack.

3. The sensor assembly of claim 1, wherein the jack includes a contact end opposite the mating end, the mounting surface formed on the contact end.

4. The sensor assembly of claim 1, wherein the jack includes a contact end opposite the mating end, the mounting surface extending between the contact end and the mating end.

5. The sensor assembly of claim 1, wherein the sensor end of the plug includes a contact assembly, the lead configured to be coupled to the contact assembly.

6. The sensor assembly of claim 1, wherein the sensor end of the plug includes a contact assembly having a crimp, the lead configured to be coupled to the crimp.

7. The sensor assembly of claim 1 further comprising a contact assembly, the lead configured to be coupled to the contact assembly, the contact assembly configured to be inserted into the sensor end of the plug.

8. The sensor assembly of claim 1, wherein the number of plug contacts corresponds to at least the number of leads.

9. The sensor assembly of claim 1, wherein the plug is removable from the jack so that the sensor can be replaced.

10. An electrical assembly comprising:

a card assembly;

a jack having a mounting surface and a mating end, the mounting surface mounted to the card assembly such that the jack is positioned at least one of substantially parallel to or substantially perpendicular to a surface of the card assembly, the mating end having jack contacts;

a plug having a mating end and a sensor end, the mating end having plug contacts, the mating end of the plug configured to be inserted into the mating end of the jack such that the plug contacts engage the jack contacts; and a sensor having a lead, the sensor configured to monitor the card assembly, the lead configured to be inserted into the sensor end of the plug to electrically couple the sensor to the card assembly wherein the sensor senses a property of the card assembly.

11. The electrical assembly of claim 10, wherein the jack includes a latch and the plug includes a tab, the tab configured to engage the latch to secure the plug to the jack.

12. The electrical assembly of claim 10, wherein the sensor end of the plug includes a contact assembly, the lead configured to be coupled to the contact assembly.

13. The electrical assembly of claim 10, wherein the sensor end of the plug includes a contact assembly having a crimp, the lead configured to be coupled to the crimp.

14. The electrical assembly of claim 10 further comprising a contact assembly, the lead configured to be coupled to the contact assembly, the contact assembly configured to be inserted into the sensor end of the plug.

15. The electrical assembly of claim 10, wherein the number of plug contacts corresponds to at least the number of leads.

16. The electrical assembly of claim 10, wherein the plug is removable from the jack so that the sensor can be replaced.

17. A sensor assembly comprising:

a jack having a mounting surface and a mating end, the mounting surface configured to be mounted to a card assembly, the mating end having jack contacts;

a plug having a mating end and a sensor end, the mating end having plug contacts, the mating end of the plug configured to be inserted into the mating end of the jack such that the plug contacts engage the jack contacts;

a contact assembly configured to be inserted into the sensor end of the plug; and a sensor having a lead, the sensor configured to monitor the card assembly, the lead configured to couple to the contact assembly to electrically couple the sensor to the card assembly wherein the sensor senses a property of the card assembly.

18. The sensor assembly of claim 17, wherein the number of plug contacts corresponds to at least the number of leads.

19. The electrical assembly of claim 17, wherein the plug is removable from the jack so that the sensor can be replaced.

20. The electrical assembly of claim 17, wherein the jack includes a latch and the plug includes a tab, the tab configured to engage the latch to secure the plug to the jack.

* * * * *